US009137612B2

(12) United States Patent
Naylor

(10) Patent No.: US 9,137,612 B2
(45) Date of Patent: Sep. 15, 2015

(54) HEARING AID COMPRISING A FEEDBACK ALARM

(71) Applicant: OTICON A/S, Smørum (DK)

(72) Inventor: Graham Naylor, Smørum (DK)

(73) Assignee: OTICON A/S, Smorum (DK)

( * ) Notice: Subject to any disclaimer, the term of this patent is extended or adjusted under 35 U.S.C. 154(b) by 36 days.

(21) Appl. No.: 13/922,451

(22) Filed: Jun. 20, 2013

(65) Prior Publication Data

US 2013/0343587 A1 Dec. 26, 2013

Related U.S. Application Data

(60) Provisional application No. 61/662,391, filed on Jun. 21, 2012.

(30) Foreign Application Priority Data

Jun. 21, 2012 (EP) ..... 12172959

(51) Int. Cl.
*H04R 25/00* (2006.01)

(52) U.S. Cl.
CPC ..... *H04R 25/453* (2013.01); *H04R 25/45* (2013.01); *H04R 25/305* (2013.01)

(58) Field of Classification Search
CPC ..... H04R 25/45; H04R 25/453; H04R 25/30; H04R 25/305
USPC ..... 381/93, 312, 317, 318, 314
See application file for complete search history.

(56) References Cited

U.S. PATENT DOCUMENTS

| | | | | |
|---|---|---|---|---|
| 5,442,712 | A * | 8/1995 | Kawamura et al. | 381/83 |
| 8,144,895 | B2 * | 3/2012 | Ura | 381/93 |
| 2009/0196445 | A1 * | 8/2009 | Elmedyb et al. | 381/318 |
| 2010/0226516 | A1 | 9/2010 | Grafenberg et al. | |
| 2011/0188685 | A1 * | 8/2011 | Sheikh | 381/318 |
| 2012/0288107 | A1 * | 11/2012 | Lamm et al. | 381/59 |

FOREIGN PATENT DOCUMENTS

| | | | |
|---|---|---|---|
| EP | 1 718 110 | A1 | 11/2006 |
| JP | 2011-082647 | A | 4/2011 |
| WO | WO 2011/026113 | A2 | 3/2011 |

* cited by examiner

*Primary Examiner* — Curtis Kuntz
*Assistant Examiner* — Sabrina Diaz
(74) *Attorney, Agent, or Firm* — Birch, Stewart, Kolasch & Birch, LLP

(57) ABSTRACT

A hearing aid comprises a microphone configured to receive an acoustic input signal and convert the signal into an electric input signal, an audiological signal processing unit coupled to the microphone and configured to process the electric input signal to a processed signal, an amplifier coupled to the audiological signal processing unit and configured to amplify the processed signal to an amplified signal, and a receiver coupled to the amplifier and configured to transform the amplified signal into an acoustic output signal. The hearing aid further comprises a howl detector coupled to the signal processing unit and configured to detect the presence of a feedback howl originating from the hearing aid an analyzer coupled to the howl detector and configured to determine a value indicative of whether the feedback howl detected is potentially audible to a person neighboring the user of the hearing aid.

22 Claims, 3 Drawing Sheets

HEARING AID COMPRISING A FEEDBACK ALARM

CROSS REFERENCE TO RELATED APPLICATIONS

This application claim priority under 35 U.S.C. § 119(e) to U.S. Provisional Application No. 61/662,391 filed on Jun. 21, 2012. This application also claims priority under 35 U.S.C. § 119(a) to Patent Application No. 12172959.4 filed in Europe on Jun. 21, 2012. The entire contents of all of the above applications is hereby incorporated by reference.

TECHNICAL FIELD

The present disclosure relates to a hearing aid. The present disclosure furthermore relates to a corresponding operating method of operating a hearing aid and to a corresponding computer program.

BACKGROUND OF THE INVENTION

It is often observed that a hearing-aid user's hearing aid whistles or howls for a significant period of time, and so loudly that people around the user can hear it. Such whistling or howling results from inadequate feedback cancellation capabilities of prior art hearing aids, often leaving only manual user actions (e.g. re-positioning of the aid, or reducing gain/volume) to rectify the situation. Since the undesired feedback is inaudible for the user, action is not taken until someone else draws the user's attention to the problem. This causes embarrassing situations for friends, family, bystanders, and usually for the users themselves.

WO 2011/026113 A1 discloses a method and system for informing a user about hearing aid feedback noise including, for example, receiving, through one or more microphones, an acoustic signal sample, analyzing the acoustic signal sample to determine whether feedback noise is present in the acoustic signal sample, and displaying to the user an indication of whether feedback noise is present in the acoustic signal sample.

DESCRIPTION OF THE INVENTION

It is an object of the present disclosure to provide a hearing aid that can be operated less conspicuously.

A hearing Aid:

Regarding the hearing aid the object is achieved by a hearing aid comprising a howl detector coupled to the signal processing unit and being configured to detect the presence of a feedback howl originating from the hearing aid, an analyzer coupled to the howl detector and being configured to determine a first value indicative of whether or not the feedback howl detected is potentially audible to a person neighbouring the user of the hearing aid, and a trigger unit operatively connected to the analyzer and being configured to trigger a corrective action considering the first value.

The term 'a person neighbouring the user of the hearing aid' is in the present context taken to mean a person that is within hearing distance of a howl created by the hearing aid. Such neighbouring person may e.g. be taken to be within 3 m of the user, such as within 2 m or 1 m of the user wearing the hearing aid creating the howl.

A corrective action in the sense of the present disclosure is an action performed by the hearing aid automatically, e.g. such as attenuating the amplified signal presented to the receiver, informing the user, etc. A corrective action can e.g. comprise playing a warning signal for the user (via a signal perceived by the user as an acoustic signal, e.g. via a speaker unit). Such corrective action may e.g. comprise playing a warning message to the user via an output transducer (e.g. speaker unit), where the warning signal is appropriately adapted in frequency and gain to allow the user to perceive the message conveyed by the warning signal (considering the user's hearing ability, e.g. impairment). A corrective action may additionally or alternatively include communicating a warning to the user by a visual indication or by a mechanical (vibration) indication. A corrective action can inform the user to preferably perform a manual user action.

The fact that the trigger unit triggers a corrective action considering the first value does not necessarily mean that the triggering is performed using the first value exclusively. Instead the first value may be further processed or weighted using other values and afterwards fed to the trigger unit.

In an embodiment, the hearing aid is adapted to provide a frequency dependent gain to compensate for a hearing loss of the user. Various aspects of digital hearing aids are described in [Schaub; 2008] (Arthur Schaub, Digital hearing Aids, Thieme Medical. Pub., 2008).

The hearing aid of the present disclosure combines the detection of a feedback howl with the assessment whether or not the feedback howl is potentially audible to a person neighbouring the user of the hearing aid. The present disclosure includes the recognition that it is not necessary to initiate a corrective action for every feedback howl, but only for those potentially leading to embarrassing situations for the hearing aid user.

Thus, the disclosure presents a better solution than previously known solutions because it reduces the incidence of embarrassing situations for the hearing aid user and his/her family and acquaintances.

In order to detect a feedback howl, the howl detector can comprise calculation means configured to perform e.g. a FFT on the processed signal transmitted to the howl detector by the audiological signal processing unit. Preferably, the howl detector is configured to determine the frequency and/or amplitude of a howl. Advantageously the howl detector is configured to detect and/or transmit a frequency and/or an amplitude (and/or a duration) of the feedback howl detected to the analyzer. In an embodiment, the hearing aid comprises a memory and is adapted to store one or more of the characteristics of a howl-event in the memory. In an embodiment such characteristics include a centre frequency, a corresponding amplitude, and a duration in time. In an embodiment, characteristics of a number of howl events are stored in the memory. Thereby an indication of the character of the howl event(s) can be extracted, e.g. as indicated by a frequency of howl-events. In an embodiment, such information is used as an input to the analyzer and/or the discriminator to influence a possible corrective action. Howl detection in hearing aids is e.g. described in EP 1 718 110 A1.

In the present context howl due to acoustic feedback is taken to refer to narrow-band frequency components that are distinct in the wide band acoustic signal. In an embodiment, howl is assumed, when a peak is detected in the input signal picked up by the microphone of the hearing aid and where the peek is NOT assumed to form part of the target input signal. In an embodiment, a howl feedback component is assumed to comprise a signal component above a predefined minimum level, e.g. 30 dB SPL. In an embodiment, a feedback component is assumed to comprise a signal component in a relatively narrow frequency range, e.g. less than 40 Hz.

In an embodiment, the hearing aid comprises a level detector for determining the level of an input signal (e.g. a speech signal) and/or a howl (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels. The level of the howl may be used as an input to the discriminator (indicating the severity of the event).

In an embodiment, the first value indicative of whether or not the feedback howl detected is potentially audible to a person neighbouring the user of the hearing aid comprises an estimate of the sound pressure level $SPL_{howl}$ from a howl in the hearing aid worn by the user at a distance DIST within the user's nearest environment. In order to calculate whether or not the feedback howl is potentially audible to a person neighbouring the user of the hearing aid, the analyzer can be configured to estimate from the amplitude of the howl (and/or hearing aid characteristics) a sound pressure level of the feedback howl occurring at a typical distance between the hearing aid and a bystander. Such a typical distance can be, for example, 80 cm. If a sound pressure level of the detected howl at the typical distance is, for example, less than 10 dB SPL, the howl is unlikely to be audible to a bystander. A criterion for taking a corrective action may thus be expressed as $SPL_{howl}(DIST)>SPL_{max,acc}$, where $SPL_{howl}(DIST)$ is the estimated sound pressure level from a howl in the hearing aid worn by the user at a distance DIST within the user's nearest environment, and $SPL_{max,acc}$ is the maximum acceptable sound pressure level at a bystander's location. In an embodiment, DIST is smaller than 3 m, such as smaller than 2 m, such as smaller than 1 m. In an embodiment, $SPL_{max,acc}$ is larger than 6 dB (SPL), such as larger than 10 dB (SPL), such as larger than 20 dB (SPL). $SPL_{howl}(DIST)$ may e.g. be determined for a given howl incident from the measured level of the current howl. It may e.g. be read from a predefined table stored in a memory of the hearing aid, the table listing measured howl level in the hearing aid and estimated howl level at various distances from the user wearing the hearing aid. Alternatively, it may be determined in the hearing aid from the current howl level and a specific distance, e.g. a maximum distance of interest, e.g. by free field calculations. It is to be understood that the analyzer can be configured to weigh the sound pressure level using e.g. the frequency of the howl (or its level or its duration). Furthermore other psychoacoustic values known to the skilled person can be implemented in the analyzer in order to determine whether or not the feedback howl is potentially audible to a person neighbouring the user of the hearing aid. In an embodiment, the hearing aid (e.g. the analyzer) is adapted to log (recent) events related to the environment of the user. In an embodiment, the hearing aid (e.g. the analyzer) is adapted to log whether the voice of a human being has been detected by the hearing aid within a predefined time interval from the current time. In an embodiment, such information is used (e.g. to the discriminator or the trigger unit) to influence a possible corrective action. In case no recent events of voice-detection in the user's environment has occurred, the need for corrective action (to please the environment) may be less than if one or more recent of voice-detection-events has been registered. In an embodiment, the analyzer is adapted to cyclically log the point in time (and possibly duration and/or the average level, e.g. the average power spectral density, PSD) of the most recent voice-detection-events, e.g. within the last 60 s (1 minute), or within the last 300 s (5 minutes).

In a particular embodiment, the hearing aid comprises a voice activity detector for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector is adapted to classify a current acoustic environment of the user as a VOICE or NO-VOICE environment. In an embodiment, the hearing aid comprises a memory, wherein the most recent occurrences of voice detection are stored (possibly together with a level indication of the detected voice). This allows an estimate of the time elapsed from the last occurrence (or a number of the last occurrences) of voice detection to the current time, whereby an indication of the current acoustic environment of the user is provided. Voice detection in hearing aids is e.g. dealt with in WO 91/03042 A1.

The first value calculated by the analyzer can be a simple signal, flagging periods of time in which a feedback howl originating from the hearing aid is potentially audible to a person neighbouring the user of the hearing aid. The first value calculated by the analyzer can also be multi-valued.

In a preferred embodiment the analyzer is further configured to determine a second value indicative of whether or not the feedback howl detected is potentially inaudible to the hearing aid user. The present disclosure also includes the recognition that a feedback howl is not necessarily audible for the user of the hearing aid and the information about an occurring howl has to be made accessible to the user differently, e.g. depending on the hearing impairment of the user. To determine that, the amplitude and/or frequency of a feedback howl can be compared by the analyzer to an individual hearing profile of a user (e.g. an audiogram for the ear at which the hearing aid is worn) that may be stored in the hearing aid. If, for example, the howl detected is potentially inaudible to the hearing aid user, the analyzer could raise a flag indicating that, e.g. by delivering an information signal to the user in a frequency range (and gain) where he/she is able to perceive the information.

In a further preferred embodiment, the hearing aid comprises a discriminator configured to create an impact value indicative of whether or not the feedback howl detected persists over a significant period of time. Thereby it can be achieved that a corrective action is not initiated for short-lived feedback howl, thus avoiding unnecessary interference in the normal operation of the hearing aid. In the simplest case, a significant period of time can be a predetermined time period stored in the hearing aid, e.g. 1500 ms. A feedback howl occurring for a period of time less than this predetermined time period would be assigned a low impact value, e.g. in the simplest case a zero-flag.

In a preferred embodiment the trigger unit is configured to further trigger the corrective action according to the second value and/or the impact value. This means that a corrective action may not only be triggered dependent on whether the howl detected is potentially audible to a person neighbouring the user of the hearing aid, as indicated by the first value, but also whether the howl detected e.g. persists over a significant period of time, as indicated by the impact values or whether the howl detected is potentially inaudible to the hearing aid user, as indicated by the second value.

Naturally, the manner in which the first, second and impact values are combined/merged in order for the trigger unit to trigger a corrective action will depend on the specific use case. In an embodiment, a weighting of the values is implemented in dependence of the user (e.g. of the user's hearing impairment).

In a preferred embodiment the hearing aid comprises a signaller operatively coupled to both the trigger unit and the receiver. The signaller can be configured to present to the receiver an electric signal transformable to an acoustic sound perceivable by the user (e.g. an information signal). Alternatively or additionally, the signaller can be configured to create an information signal perceivable by the user as a vibration (e.g. of a particular pattern indicating a particular information), e.g. a vibration of the hearing aid. In an embodiment, the hearing aid comprises a wireless interface to an auxiliary device, allowing the signaller to create an information signal, which is transmitted to an auxiliary device, e.g. a cellular telephone (e.g. transmitted as an SMS), or a remote control (or a contra-lateral hearing aid of a binaural fitting), for indication to the user via said device, e.g. via a light indicator, e.g. an LED or a display, via a speaker and/or a vibration of the auxiliary device. In an embodiment, the auxiliary device is a Smartphone, configured to receive the information signal and to transfer the information to a user of the Smartphone, e.g. by a text message or by a graphic illustration or a combination thereof on a display of the Smartphone.

The electric signal presented to the receiver can be a pre-stored and/or on-demand generated warning signal. Presenting such warning signal to a user can be a first corrective action. This is especially suitable if the feedback howl, as indicated by the second value, is inaudible to the hearing aid user. In this case the user is informed via the warning signal.

The hearing aid can comprise an attenuator operatively coupled to the trigger unit and being configured to attenuate the amplified signal presented to the receiver. Such attenuation can be a second corrective action resulting in the feedback howl to vanish. Attenuation can be performed partially or totally, preferably solely in a frequency band surrounding the feedback howl.

In an embodiment, the hearing aid comprises an acoustic (and/or mechanical) feedback suppression system. In an embodiment, feedback cancellation (or at least reduction) is implemented by subtracting an estimate of the feedback signal within the hearing aid from the input signal. Preferably, the feedback cancellation system comprises an adaptive filter allowing to track feedback path changes over time. The adaptive filter comprises a linear time invariant filter to estimate the feedback path, which has its filter weights updated over time with a certain update or adaptation rate [Engebretson, 1993] (A. Engebretson, M. French-St. George, "Properties of an adaptive feedback equalization algorithm", J. Rehabil. Res. Dev., 30(1), pp. 8-16, 1993). The filter updates are e.g. calculated using stochastic gradient algorithms, including some form of the Least Mean Square (LMS) or the Normalized LMS (NLMS) algorithms. Thereby the error signal (the feedback corrected input signal) is minimized in the mean square sense. Various aspects of adaptive filters are e.g. described in [Haykin] (S. Haykin, Adaptive filter theory (Fourth Edition), Prentice Hall, 2001).

In an embodiment, the hearing aid comprises an antenna and transceiver circuitry for wirelessly receiving an electric input signal from another device, e.g. a communication device, a remote control or another hearing aid.

In a further embodiment, to enable the hearing aid for a third corrective action, the electric signal presented to the receiver is a substitute signal. The substitute signal can represent an acoustic input signal of a hearing aid component distinct from the hearing aid.

If, for example, the hearing aid and the hearing aid component distinct from the hearing aid form a binaural hearing aid system, a feedback howl occurring in either one of the two components can be substituted using a substitute signal from the respective other component. This is a quite acceptable measure for as long the feedback howl persists. The substitute signal can at least partially substitute the amplified signal and/or the processed signal.

In a preferred embodiment, to further increase the hearing comfort while a feedback howl occurs, the frequency band of the substitute signal includes merely the frequency band of the feedback howl detected.

It is to be understood that the three corrective actions described above can be combined arbitrarily. If, for example, the attenuator attenuates the amplified signal presented to the receiver, which also means less auditory information for the hearing aid user, it is suitable that the signaller is configured to signal a warning signal to the hearing aid user giving him/her the chance to react promptly.

It is to be understood that, as modern hearing aid include versatile processing means, the functionality of functional components, e.g. the howl detector, the analyzer and so forth can be realized in one of the same processing means.

A hearing Aid System:

In a further aspect, a hearing aid system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone (e.g. a Smartphone) or a computer, e.g. a PC) and adapted for allowing the selection and/or combination of an appropriate one of the received audio signals (or combination of signals) for transmission to the hearing aid. In an embodiment, the auxiliary device is or comprises a remote control for controlling functionality and operation of the hearing aid(s). In an embodiment, the auxiliary device is or comprises a Smartphone.

In an embodiment, the auxiliary device is another hearing aid. In an embodiment, the system comprises two hearing aids adapted to implement a binaural hearing aid system.

In an embodiment, the auxiliary device is adapted to detect the howl of the hearing aid and to transmit an information signal to the hearing aid in case howl is detected from the hearing aid in question. Such auxiliary device(s) may e.g. be located in a room, where the user is expected to be present, e.g. in a living room or an auditorium, e.g. a class room).

A Method:

Regarding the operating method of operating a hearing aid the object is achieved by operating a hearing aid with the steps of:

- receiving an acoustic input signal and converting the signal into an electric input signal and processing the electric input signal to a processed signal
- detecting the presence of a feedback howl originating from the hearing aid, preferably using the processed signal and/or control signals from an audiological signal processing unit comprised by the hearing aid
- determining a first value indicative of whether or not the feedback howl detected is potentially audible to a person neighbouring the user of the hearing aid
- triggering a corrective action according to the first value.

Principally the operating method of the present disclosure shares the advantages of the hearing aid of the present disclosure. In particular, the operating method has preferred embodiments that correspond to additional features of the embodiments of the hearing aid described above. For instance, in a preferred embodiment, the method comprises the step of presenting to the receiver, as a first corrective action, a pre-stored and/or on-demand generated warning signal that is transformable to an acoustic sound perceivable by the user.

In a further preferred embodiment the method comprises the step of attenuating, as a second corrective action, the amplified signal presented to the receiver.

Alternatively or additionally the operating method can comprise the step of presenting to the receiver, as a third corrective action, a substitute signal representing an acoustic input signal of a hearing aid component distinct from the hearing aid.

A Computer Program:

Regarding the computer program, the above identified object is achieved by a computer program for operating a hearing aid, the computer program comprising program code means for causing the hearing aid to carry out the steps of the operating method as described above, when the computer program is run on a computer controlling the hearing aid.

BRIEF DESCRIPTION OF THE DRAWINGS

These and other aspects of the disclosure will be apparent from and elucidated with reference to the embodiments described hereinafter.

In the following drawings.

DESCRIPTION OF THE EMBODIMENTS

Figure 1:
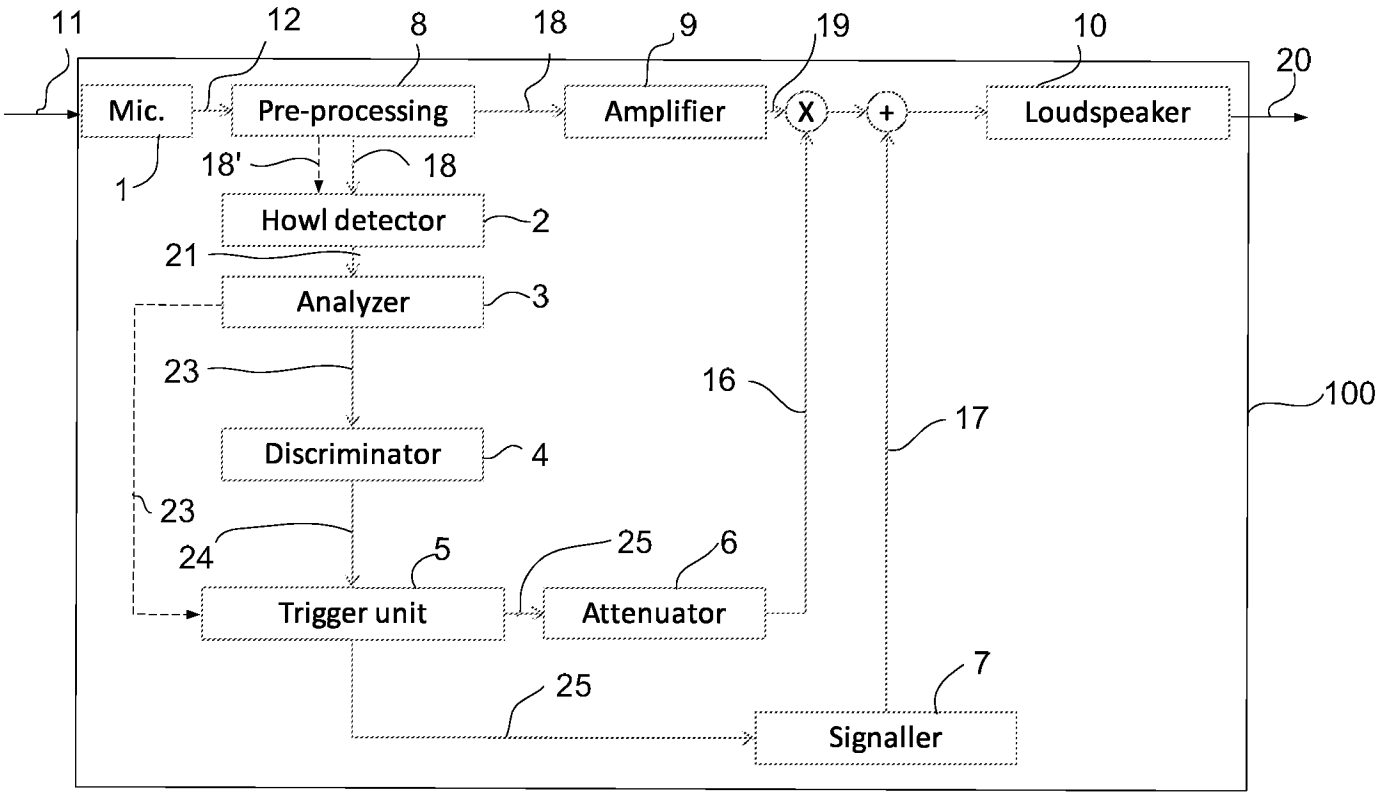
FIG. 1 shows schematically and exemplary an embodiment of a hearing aid in accordance with the disclosure.

As a conventional hearing aid, the hearing aid 100 in FIG. 1 comprises a microphone (Mic.) 1 configured to receive an acoustic input signal 11 and to convert the acoustic input signal 11 into an electric input signal 12, an audiological signal processing unit (Pre-processing) 8 coupled to the microphone 1 and being configured to process the electric input signal 12 to a processed signal 18, an amplifier (Amplifier) 9 coupled to the audio-logical signal processing unit 8 and being configured to amplify the processed signal 18 to an amplified signal 19 and a receiver (Loudspeaker) 10 coupled to the amplifier 9 and being configured to transform the amplified signal 19 into an acoustic output signal 20.

Depicted branching off from the signal processing unit 8 is a howl detector (Howl detector) 2, which is configured to detect the presence of a feedback howl and to determine frequency and amplitude (and possibly duration) of the howl. As can be seen from FIG. 1, the processed signal 18 originating from the audiological signal processing unit 8 is fed to the howl detector 2 as an input signal. This signal may be the electric input signal 12 directly or a processed version thereof (e.g. a feedback corrected version, in case the hearing aid comprises a feedback cancellation system). In an embodiment, the amplified signal 19 may alternatively or additionally be fed to the howl detector 2. Optionally other control signals 18', indicated by the dotted arrow, can be fed to the howl detector for the detection of a howl.

If a howl is detected, a signal 21 representing the frequency and/or the amplitude of the howl is transmitted to an analyzer (Analyzer) 3, which is coupled to the howl detector 2. The analyzer 3 is configured to determine a first value 23 indicative of whether or not the feedback howl detected is potentially audible to a person neighbouring the user of the hearing aid 100. In this embodiment the first value 23 is a simple signal that flags periods of time in which bystanders are likely to be hearing a howl from the hearing aid 100. In an exemplary embodiment, the analyzer 3 is further configured to determine a second value indicative of whether or not the feedback howl detected is potentially inaudible to the hearing aid user. The second value is optionally used as an input to the discriminator 4 and/or to the trigger unit 5.

Operatively connected to the analyzer 3 is a discriminator (Discriminator) 4 which is configured to create an impact value 24 indicative of whether or not the feedback howl detected persists over a significant period of time. Input to the discriminator 4 is the first value 23 determined by the analyzer 3. The impact value 24 is transmitted from the discriminator 4 to a trigger unit (Trigger unit) 5, which is operatively connected to the discriminator 4.

Indicated by the dotted arrow with the numeral 23 is that the first value 23 can not only be fed to the discriminator 4 for further calculation, but directly to the trigger unit 5 as well. Hence, the trigger unit 5 may be configured to trigger a corrective action considering the first value 23, the second value, and/or the impact value 24. Further, the trigger unit may terminate a corrective action, when the howl condition no longer persists and/or when a user action has been taken. The trigger unit may thus initiate the return to a normal mode of operation. In an embodiment, the trigger unit is adapted to activate a feedback cancellation system, and/or to modify an adaptation rate of an adaptive algorithm of the feedback cancellation system.

The hearing aid 100 of FIG. 1 further comprises an attenuator (Attenuator) 6 operatively coupled to the trigger unit 5. The attenuator 6 is configured, to provide for a second corrective action, to attenuate the amplified signal 19 presented to the receiver 10, cf. signal 16, e.g. comprising an attenuation factor that is to be multiplied onto the amplified signal 19 via combination unit ('X'). It can also be seen from FIG. 1 that the hearing aid 100 comprises a signaller (Signaller) 7. The signaller 7 is operatively coupled to the trigger unit 5 as well as to the receiver 10. Furthermore the signaller is configured to present to the receiver 10 an electric signal 17 transformable to an acoustic sound perceivable by the user. In the present embodiment the electric signal 17 presented to the receiver 10, to provide for a first corrective action, is a pre-stored warning signal, pre-stored in the signaller 7. Alternatively, the warning signal may be generated on demand, e.g. using an on-board speech synthesizer. Further alternatively, the warning signal may be requested to be transmitted from an auxiliary device to which a wired or wireless interface exists.

If the trigger unit 5 transmits a trigger signal 25—as in the present embodiment—to both the attenuator 6 and the signaller 7, two corrective actions, namely the first and the second corrective action, are performed. The control signal 16 originating from the attenuator 6 attenuates, e.g. mutes, the amplified signal 19 presented to the receiver 10. This results in the howl to disappear. Secondly a warning signal pre-stored in the signaller 7 is transmitted via transmission line 17 (and combination unit ('+'), allowing a combination with the possibly attenuated signal 19 of the forward path) to the loudspeaker, informing the hearing aid user to perform a manual user action.

When howl is no longer present, the algorithms embodied in the microphone, 1, the signal processing unit (8, 9), the howl detector 2, the analyzer 3, the discriminator 4, the trigger 5, the attenuator 6 and the signaller 7 effect a termination of the corrective action, such that the hearing aid returns to normal mode of operation.

Figure 2:
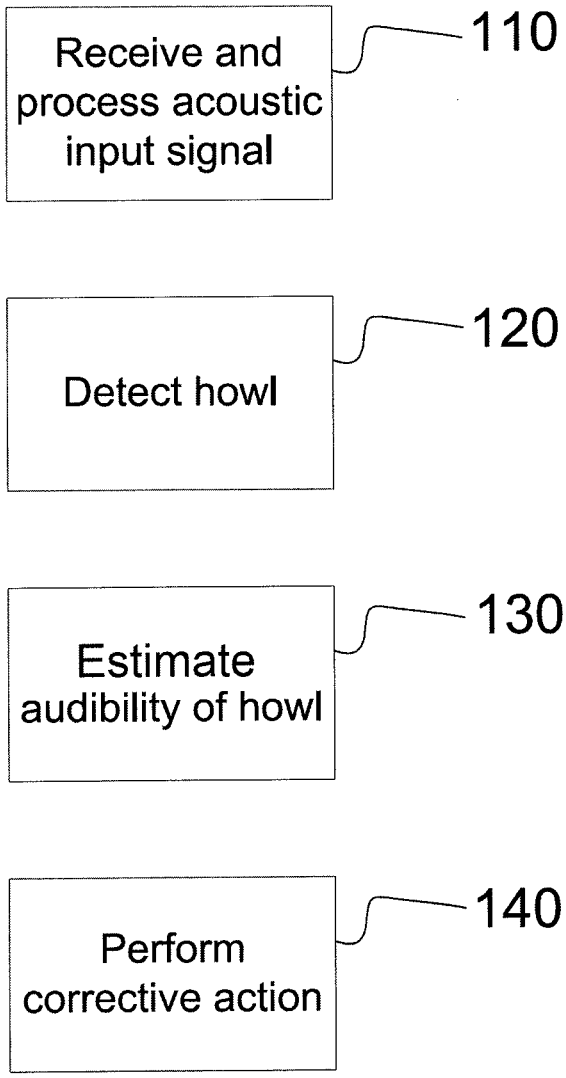
FIG. 2 shows exemplary a flow chart illustrating an embodiment of an operating method in accordance with the disclosure, FIG. 3 schematically shows a hearing aid according to the present disclosure.

An exemplary flow chart illustrating an embodiment of an operating method in accordance with the disclosure is depicted in FIG. 2.

In a first step (Receive and process acoustic input signal) 110 an acoustic input signal is received and converted into an electric input signal via a hearing aid's microphone. The electric signal is processed into a processed signal using an audiological signal processing unit coupled to the microphone.

In a second step (Detect howl) 120, the presence of a feedback howl originating from the hearing aid is detected. The detection is performed preferably using the processed signal and/or control signals from the audiological signal processing unit comprised by the hearing aid.

In a third step (Estimate audibility of howl) 130 a first value indicative of whether or not the feedback howl detected is potentially audible to a person neighbouring the user of the hearing aid is determined.

Considering the first value determined in the third step 130, in a fourth step (Perform corrective action) 140 a corrective action, e.g. attenuating an amplified signal presented to the receiver, is performed.

It is to be understood that since the acoustic input signal picked up by hearing aid's microphone is a continuous signal, the steps of the operating method can be performed continuously/repeatedly.

Figure 3:
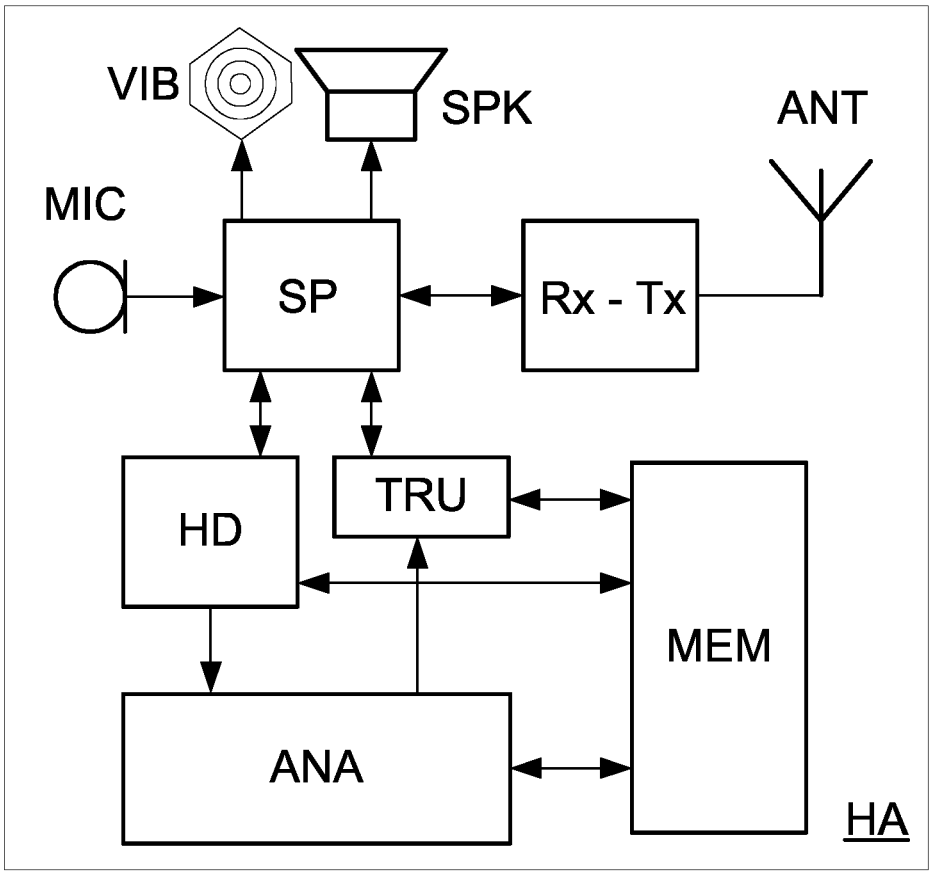

FIG. 3 schematically shows a hearing aid according to the present disclosure. The hearing aid (HA) comprises a microphone (MIC) configured to convert an acoustic input signal to an electric input signal, a signal processing unit (SP) coupled to the microphone (MIC) and being configured to process the electric input signal to a processed signal (including applying a frequency dependent gain to the electric input signal (or a signal derived there from) according to a user's needs, e.g. his or her hearing impairment), and a receiver (loudspeaker, SPK) coupled to the signal processing unit (SP) and being configured to transform the processed signal signal into an acoustic output signal. The microphone (MIC), signal processing unit (SP) and receiver (SPK) form part of a forward path of the hearing aid. The forward path may further comprise analogue-to-digital and digital-to-analogue converters allowing digital signal processing in the forward path (and possibly elsewhere, e.g. in an analysis path) to be performed. The signal processing unit (SP) is further adapted for performing logic actions based on one or more control inputs. The hearing aid (HA) further comprises a howl detector (HD) coupled to the signal processing unit (SP) and being configured to detect the presence of a feedback howl originating from the hearing aid (HA), an analyzer (ANA) coupled to the howl detector (HD) and being configured to determine control signal (at least being) indicative of whether or not the feedback howl detected is potentially audible to a person neighbouring the user of the hearing aid (HA). The hearing aid (HA) further comprises a trigger unit (TRU) operatively connected to the analyzer (ANA) and being configured to trigger a corrective action considering the control signal from the analyzer. The hearing aid (HA) further comprises a memory unit (MEM) operatively coupled to the howl detector (HD), the analyzer (ANA), and the trigger unit (TRU), thereby allowing said units to store and/or retrieve information in/from the memory unit (MEM). The memory may e.g. hold data relating to the user (e.g. an audiogram), a criterion for deciding whether a detected feedback is audible for a person in the user's environment, statistical data for the occurrence of howl, statistical data for the occurrence of speech in the user's environment, etc. The hearing aid (HA) further comprises an antenna (ANT) and transceiver unit (Rx-Tx) for establishing a wireless link to another device, e.g. a second hearing aid of a binaural hearing aid system or a remote control or another communication device. Thereby, control signals, information signals and/or audio data signals may be exchanged between the devices (possibly one-way).

The signal processing unit (SP) may be adapted to implement a corrective action based on inputs from the howl detector (HD), the analyzer (ANA) and the trigger unit (TRU). Such corrective action may e.g. be to play a warning message to the user via the speaker (SPK), where the warning signal is appropriately adapted in frequency and gain to allow the user to perceive the message conveyed by the warning signal.

Preferably, corrective action is only taken when it is concluded form the available control signals (e.g. from the howl detector, the analyzer, the trigger unit, data stored in the memory, etc.) that a feedback howl is present and it is potentially audible to a person neighbouring the user of the hearing aid. In an embodiment, corrective action is only taken when it is further concluded that the detected feedback howl is potentially inaudible to the hearing aid user (e.g. due to a hearing impairment of the user). Preferably data reflecting a user's frequency dependent hearing ability (e.g. hearing loss compared to a normally hearing person, e.g. an audiogram) are stored in the memory, thereby allowing a judgement whether a given howl (with a given sound pressure level and frequency) is audible to the user.

The hearing aid (HA) may further contain a vibrating element (VIB) for conveying an information relating to a detected feedback in the hearing aid to the user (encouraging the user to take action to reduce such howl, e.g. by reducing volume, improving the positioning of the hearing aid at the ear of the user, etc.).

The hearing aid (HA) may further contain other functional blocks/components than those depicted in FIG. 3, e.g. a feedback cancellation system. Typically, the hearing aid comprises a local source of energy, e.g. a battery, e.g. a rechargeable battery, for energizing some or all of the functional components of the hearing aid.

The invention claimed is:

1. A hearing aid, comprising:

a microphone configured to receive an acoustic input signal and to convert the acoustic input signal into an electric input signal;

an audiological signal processing unit coupled to the microphone and being configured to process the electric input signal to a processed signal;

an amplifier coupled to the audiological signal processing unit and being configured to amplify the processed signal to an amplified signal;

a receiver coupled to the amplifier and being configured to transform the amplified signal into an acoustic output signal;

a howl detector coupled to the signal processing unit and being configured to detect the presence of a feedback howl originating from the hearing aid;

an analyzer coupled to the howl detector and being configured to determine a first value indicative of whether or not the feedback howl detected is potentially audible to a person neighbouring a user of the hearing aid; and a trigger unit operatively connected to the analyzer and being configured to trigger a corrective action considering the first value, wherein the first value is indicative of whether or not the feedback howl detected is potentially audible to the person neighbouring the user of the hearing aid and comprises an estimate of the sound pressure level $SPL_{howl}$ from the feedback howl in the hearing aid worn by the user at a distance DIST within the user's nearest environment.

2. Hearing aid according to claim 1, wherein the analyzer is further configured to determine a second value indicative of whether or not the feedback howl detected is potentially inaudible to the hearing aid user.

3. Hearing aid according to claim 1, wherein the hearing aid further comprises:

a discriminator configured to create an impact value indicative of whether or not the feedback howl detected persists over a significant period of time.

4. Hearing aid according to claim 1, wherein the howl detector is configured to detect a frequency and/or an amplitude and/or a duration of the feedback howl detected.

5. Hearing aid according to claim 1 comprising a memory and configured to store one or more of the characteristics of a number of howl-events in the memory, including one or more of a centre frequency, a corresponding amplitude, and a duration in time.

6. Hearing aid according to claim 2, wherein the trigger unit is configured to further trigger the corrective action according to the second value, and/or an impact value indicative of whether or not the feedback howl detected persists over a significant period of time, and/or characteristics of a number of howl-events.

7. Hearing aid according to claim 1, wherein the hearing aid further comprises a signaller operatively coupled both the trigger unit and the receiver and being configured to present to the receiver an electric signal transformable to an acoustic sound perceivable by the user.

8. Hearing aid according to claim 7, wherein the electric signal presented to the receiver is, as a first corrective action, a pre-stored and/or on-demand generated warning signal.

9. Hearing aid according to claim 1, wherein the hearing aid further comprises an attenuator operatively coupled to the trigger unit and being configured, as a second corrective action, to attenuate the amplified signal presented to the receiver.

10. Hearing aid according to claim 1 comprising a voice activity detector.

11. Hearing aid according to claim 10 configured to log whether the voice of a human being has been detected by the hearing aid within a predefined time interval from the current time, and to use such information to influence a possible corrective action.

12. Hearing aid according to claim 1, wherein the amplified signal presented to the receiver comprises, as a third corrective action, a substitute signal representing an acoustic input signal of a hearing aid component distinct from the hearing aid.

13. Hearing aid according to claim 12, wherein the substitute signal at least partially substitutes the amplified signal and/or the processed signal.

14. A hearing aid system comprising a hearing aid according to claim 1 AND an auxiliary device.

15. A hearing aid system according to claim 14 wherein the auxiliary device comprises a Smartphone.

16. A method for operating a hearing aid, the method comprising:

receiving an acoustic input signal;

converting the received acoustic input signal into an electric input signal;

processing the electric input signal to a processed signal;

detecting the presence of a feedback howl originating from the hearing aid;

determining a first value indicative of whether or not the feedback howl detected is potentially audible to a person neighbouring a user of the hearing aid;

triggering a corrective action considering the first value, wherein the first value is indicative of whether or not the feedback howl detected is potentially audible to the person neighbouring the user of the hearing aid and comprises an estimate of the sound pressure level $SPL_{howl}$ from the feedback howl in the hearing aid worn by the user at a distance DIST within the user's nearest environment.

17. Method according to claim 16, further comprising:

presenting to a receiver of the hearing aid, as a first corrective action, a pre-stored and/or on-demand generated warning signal that is transformable to an acoustic sound perceivable by the user.

18. Method according to claim 16, wherein the corrective action comprises playing a warning signal to the user via an output transducer, where the warning signal is appropriately adapted in frequency and gain to allow the user to perceive the message conveyed by the warning signal considering the user's hearing ability.

19. Method according to claim 16, further comprising:

attenuating, as a second corrective action, the processed signal presented to a receiver of the hearing aid.

20. Method according to claim 16, further comprising:

presenting to a receiver of the hearing aid, as a third corrective action, a substitute signal representing an acoustic input signal of a hearing aid component distinct from the hearing aid.

21. A computer readable tangible non-transitory recording medium encoded with computer program instructions for causing a hearing aid to carry out the steps of the method as defined in claim 16, when the computer program instructions are run on a computer controlling the hearing aid.

22. The method according to claim 16, wherein said detecting the presence of a feedback howl is performed using the processed signal and/or control signals from an audiological signal processing unit comprised by the hearing aid.

* * * * *